US005133930A

United States Patent [19]

Narayanan et al.

[11] Patent Number: 5,133,930

[45] Date of Patent: Jul. 28, 1992

[54] ALUMINUM-LITHIUM ALLOY

[75] Inventors: G. Hari Narayanan, Seattle; R. Eugene Curtis, Issaquah; William E. Quist, Redmond; Michael V. Hyatt; Sven E. Axter, both of Bellevue, all of Wash.

[73] Assignee: The Boeing Company, Seattle, Wash.

[21] Appl. No.: 492,367

[22] Filed: Mar. 9, 1990

Related U.S. Application Data

[63] Continuation of Ser. No. 94,015, Sep. 4, 1987, abandoned, which is a continuation of Ser. No. 701,124, Feb. 13, 1985, abandoned, which is a continuation-in-part of Ser. No. 567,356, Dec. 30, 1983, abandoned.

[51] Int. Cl.[5] ..... C22C 21/12

[52] U.S. Cl. ..... 420/533; 420/534; 420/535; 148/417

[58] Field of Search ..... 148/417; 420/533, 534, 420/535

[56] References Cited

U.S. PATENT DOCUMENTS 2,381,219 8/1945 Le Baron ..... 75/139
2,915,391 12/1959 Criner ..... 75/142
4,626,409 12/1986 Miller ..... 420/533

FOREIGN PATENT DOCUMENTS 2115836A 9/1983 United Kingdom ..... 420/533
2115836 9/1983 United Kingdom ..... 420/533
2126936A 4/1984 United Kingdom ..... 148/417
2137227A 10/1984 United Kingdom ..... 420/533

OTHER PUBLICATIONS

Starke, E. A., Jr., et al., *Journal of Metals* 33(8):24–33, 1981.

Lin, F. S., et al., *Metallurgical Transactions A* 13A:4-01–410, 1982.

Kar et al., Aluminum-Lithium Alloys II, Apr. 12–14, 1983 Metallurgical Society of AIME pp. 257–259.

*Primary Examiner*—Deborah Yee

*Attorney, Agent, or Firm*—Christensen, O'Connor, Johnson & Kindness

[57] ABSTRACT

An aluminum-lithium alloy exhibiting good fracture toughness and relatively high strength has a nominal composition of 2.2 percent lithium, 0.6 percent magnesium, 2.5 percent copper, 0.12 percent zirconium with the balance being aluminum and trace elements.

9 Claims, No Drawings

ALUMINUM-LITHIUM ALLOY

This application is a continuation application based Ser. No. 094,015, filed Sep. 4, 1987, which is a continuation of Ser. No. 701,124, filed Feb. 13, 1985, which is a continuation-in-part of Ser. No. 567,356, filed Dec. 30, 1983, all now abandoned.

BACKGROUND OF THE INVENTION

The present invention relates to aluminum-lithium alloys and more particularly to an aluminum-lithium alloy composition with good fracture toughness and high strength.

It has been estimated that current large commercial transport aircraft may be able to save from 15 to 20 gallons of fuel per year for every pound of weight that can be saved when building the aircraft. Over the projected 20 year life of an airplane, this savings amounts to 300 to 400 gallons of fuel. At current fuel costs, a significant investment to reduce the structure weight of the aircraft can be made to improve overall economic efficiency of the aircraft.

The need for improved performance in aircraft of various types can be satisfied by the use of improved engines, improved airframe design, and improved or new structural materials in the aircraft. Improvements in engines and aircraft design have pushed the limits of these technologies. However, the development of new and improved structural materials is now receiving increased attention, and is expected to yield further gains in performance.

Materials have always played an important role in dictating aircraft structural concepts. In the early part of this century, aircraft structure was composed of wood, primarily spruce, and fabric. Because shortages of spruce developed in the early part of the century, lightweight metal alloys began to be used as aircraft structural materials. At about the same time, improvements in design brought about the development of the all metal cantilevered wing. It was not until the 1930's, however, that the metal skin wing design became standard, and firmly established metals, primarily aluminum alloys, as the major airframe structural material. Since that time, aircraft structural materials have remained remarkably consistent with aluminum structural materials being used primarily in the wing, body and empennage, and with steel comprising the material for the landing gear and certain other speciality applications requiring very high strength materials.

Several new materials are currently being developed for incorporation into aircraft structure. These include new metallic materials, metal matrix composites and resin matrix composites. It is believed that improved aluminum alloys and carbon fiber composites will dominate aircraft structural materials in the coming decades. While composites will be used in increased percentages as aircraft structural materials, new low-density aluminum alloys, and especially aluminum-lithium alloys show great promise for extending the usefulness of aluminum alloys.

Herefore, aluminum-lithium alloys have been used only sparsely in aircraft structure. The relatively low use has been caused by casting difficulties associated with aluminum-lithium alloys and by their relatively low fracture toughness compared to other more conventional aluminum alloys. Aluminum-lithium alloys, however, provide a substantial lowering of the density of aluminum alloys (as well as a relatively high strength to weight ratio), which has been found to be very important in decreasing the overall weight of structural materials used in an aircraft. While substantial strides have been made in improving the aluminum-lithium processing technology, a major challenge still outstanding is an ability to obtain a good blend of fracture toughness and high strength in an aluminum-lithium alloy.

SUMMARY OF THE INVENTION

The present invention provides a novel aluminum alloy composition that can be worked and heat treated so as to provide an aluminum-lithium alloy with high strength, good fracture toughness, and relatively low density compared to conventional aluminum alloys that is intended to replace. An alloy prepared in accordance with the present invention has a nominal composition on the order of 2.2 weight percent lithium, 0.6 percent magnesium, 2.5 percent copper, and 0.12 percent zirconium. By moderately underaging the alloy at a low temperature, an excellent combination of fracture toughness and high strength results.

DETAILED DESCRIPTION OF THE INVENTION

An aluminum-lithium alloy formulated in accordance with the present invention can contain from about 2.0 to about 2.4 percent lithium, 0.3 to 0.9 percent magnesium, 2.3 to 2.7 percent copper, and from about 0.08 to a maximum of 0.15 percent zirconium as a grain refiner. Preferably from about 0.09 to 0.14 percent zirconium is incorporated. All percentages herein are by weight percent based on the total weight of the alloy unless otherwise indicated. The magnesium is included to increase strength without increasing density. Preferred amounts of magnesium range from about 0.4 to 0.8 percent, with 0.6 percent being most preferred. The copper adds strength to the alloy.

Iron and silicon can each be present in maximums up to a total of 0.3 percent. It is preferred that these impurities be present only in trace amounts, limiting the iron to a maximum of 0.15 percent and the silicon to a maximum of 0.12 percent, and preferably to maximums of 0.10 and 0.10 percent, respectively. The element zinc may be present in amounts up to but not exceeding 0.25 percent of the total. Titanium and chromium should not exceed 0.15 percent and 0.10 percent, respectively. Other elements such as manganese must each be held to levels of 0.05 percent or below, and the total amount of such other trace elements must be held to a maximum 0.15 percentage. If the foregoing maximums are exceeded the desired properties of the aluminum-lithium alloy will tend to deteriorate. The trace elements sodium and hydrogen are also thought to be harmful to the properties (fracture toughness in particular) of aluminum-lithium alloys and should be held to the lowest levels practically attainable, for example on the order of 15 to 30 ppm (0.0015–0.0030 wt. %) for the sodium and less than 15 ppm (0.0015 wt. %) and preferably less than 1.0 ppm (0.0001 wt. %) for the hydrogen. The balance of the alloy, of course, comprises aluminum.

An aluminum-lithium alloy formulated in the proportions set forth in the foregoing two paragraphs is processed into an article utilizing known techniques. The alloy is formulated in molten form and cast into an ingot. The ingot is then homogenized at temperatures ranging from 925° F. to 1000° F. Thereafter, the alloy is converted into a usable article by conventional mechanical formation techniques such as rolling, extrusion, or the like. Once an article is formed, the alloy is normally subjected to a solution treatment at temperatures ranging from 950° F. to 1010° F., followed by quenching in a quenching medium such as water that is maintained at a temperature on the order of 70° F. to 150° F. If the alloy has been rolled or extruded, it is generally stretched on the order of 1 to 3 percent of its original length to relieve internal stresses.

The aluminum alloy can then be further worked and formed into the various shapes for its final application. Additional heat treatments such as solution heat treatment can be employed if desired. For example, an extruded product after being cut to desired length is generally solution heat treated at a temperature on the order of995° F. for 30 minutes to 4 hours. The product is then quenched in a quenching medium held at a temperatures ranging from about 70° F. to 150° F.

Thereafter, in accordance with the present invention, the article is subjected to an aging treatment at moderately low temperatures on the order of from 250° F. to 350° F. Since this alloy is intended to replace conventional 7XXX series type alloys, it is preferred that the alloy be aged for a period of time that will allow it to achieve near peak strength, and preferably about 95percent of its peak strength. It is most preferred that the alloy be aged for a period of time allowing it to achieve 95 to 97 percent of its peak strength. Preferred aging temperatures range from 275° F. to 325° F. Within these temperatures ranges, 95 to 97 percent peak age can be achieved by aging for about 4 to 120 hours, and preferably for about 24 to 96 hours.

EXAMPLE

The following example is presented to illustrate the superior characteristics of an aluminum-lithium alloy aged in accordance with the present invention and to assist one of ordinary skill in making and using the present invention. Moreover, it is intended to illustrate the significantly improved and unexpected characteristics of an aluminum-lithium alloy formulated and manufactured in accordance with the parameters of the present invention. The following example is not intended in any way to otherwise limit the scope of this disclosure or the protection granted by Letters Patent hereon.

An aluminum alloy containing 2.2 percent lithium, 0.62 percent magnesium, 2.5 percent copper, 0.09 percent zirconium with the balance being aluminum was formulated. The trace elements present in the formulation constituted less than 0.25 percent of the total. The iron and silicon present in the formulation constituted 0.10 percent each. The alloy was and cast and homogenized at about 975° F. Thereafter, the alloy was extruded to a thickness of 0.75 inches. The resulting extrusion was then solution treated at about 975° F. for about 90 minutes. The extrusion was then quenched in water maintained at about 70° F. Thereafter, the extrusion was subjected to a stretch of about 1½ percent of its initial length. The material was then cut in specimens for fracture toughness (precrack Charpy impact test) and tensile strength testing. The precrack Charpy impact test specimens were machined to a final specimen size of 0.394×0.394×2.16 inches. The specimens prepared for tensile strength tests were standard round specimens having a gauge section diameter of 0.25 inches. A plurality of specimens were then aged for up to 72 hours at 300° F. The specimens were then subjected to tensile strength and precrack Charpy impact tests in accordance with standard ASTM and industry testing procedures. The specimens underaged at 300° F. exhibited ultimate strengths ranging on the order of 82 to 92 ksi with fracture toughness values on the order of 220 to 350 in-lbs/in$^2$.

The present invention has been described in relation to various embodiments, including the preferred formulation and processing parameters. One of ordinary skill after reading the foregoing specification will be able to effect various changes, substitutions of equivalents, and other alterations without departing from the broad concepts set forth herein. It is therefore intended that the scope of the Letters Patent granted hereon will be limited only by the definition contained in the appended claims and equivalents thereof.

The embodiments of the invention in which an exclusive property or privilege is claimed are defined as follows:

1. An aluminum-lithium alloy exhibiting good fracture toughness consisting essentially of:

| Element | Amount (wt. %) |
|---|---|
| Li | 2.0 to 2.4 |
| Mg | 0.3 to 0.9 |
| Cu | 2.3 to 2.7 |
| Zr | 0.08 to 0.15 |
| Fe | 0.15 max |
| Si | 0.12 max |
| Zn | 0.25 max |
| Ti | 0.15 max |
| Cr | 0.1 max |
| Other trace elements, each | 0.05 max |
| Other trace elements, total | 0.15 max |
| Al | Balance. |

2. The alloy of claim 1 wherein said zirconium is present in amounts from about 0.09 to 0.14 percent.

3. The alloy of claim 1 wherein said magnesium is present in an amount ranging from about 0.4 to 0.8 percent.

4. The alloy of claim 1 having a nominal composition of 2.2 percent lithium, 0.6 percent magnesium, 2.5 percent copper, and 0.12 percent zirconium.

5. The alloy of claim 1 wherein said alloy has been aged at a moderately low temperature to near peak strength.

6. The alloy of claim 1 wherein said alloy has been aged at a temperature in the range of from 250° F. to 350° F.

7. The alloy of claim 6, aged for 4 to 120 hours.

8. The alloy of claim 1 wherein said alloy has been aged at a temperature in the range of from 275° F. to 325° F.

9. The alloy of claim 8, aged for 24 to 96 hours.

* * * * *

UNITED STATES PATENT AND TRADEMARK OFFICE

CERTIFICATE OF CORRECTION

PATENT NO. : 5,133,930

DATED : July 28, 1992

INVENTOR(S) : G.H. Narayanan et al.

It is certified that error appears in the above-identified patent and that said Letters Patent is hereby corrected as shown below:

| COLUMN | LINE | |
|---|---|---|
| 1 | 62 | "Herefore" should read --Heretofore-- |
| 2 | 15 | after "that" insert --it-- |
| 3 | 17 | "of995°F" should read --of 995°F-- |
| 3 | 18 | after "at" delete "a" |
| 3 | 26 and 27 | "95per-cent" should read --95 percent-- |
| 3 | 31 | "temperatures" should read --temperature-- |
| 3 | 53 | after "was" delete "and" |
| 3 | 60 | "in" should read --into-- |
| [56] "OTHER PUBLICATIONS" (Title Page) | 4th Ref. | Please add --Sankaran et al., "Structure-property relationships in Al-Cu-Li alloys," in Aluminum-Lithium Alloys II, Proceedings of the Second International Aluminum-Lithium Conference at Monterey, CA, April 12-14, 1983, Ed. by Starke et al., AIME, Warrendale, PA, pp. 393-405, 1984.-- |
| [56] "U.S. PATENT DOCUMENTS" (Title Page) | 4th Ref. | Please add --4,840,683 2/1988 Dubost..148 12.7A |

UNITED STATES PATENT AND TRADEMARK OFFICE

CERTIFICATE OF CORRECTION

PATENT NO. : 5,133,930

DATED : July 28, 1992

INVENTOR(S) : G.H. Narayanan, et al.

It is certified that error appears in the above-indentified patent and that said Letters Patent is hereby corrected as shown below:

| | | |
|---|---|---|
| [56] "U.S. PATENT DOCUMENTS" (Title Page) | 5th Ref. | Please add --4,648,913 3/1984 Hunt et al. . . . 148 12.7A |

Signed and Sealed this

Fifteenth Day of March, 1994

*Attest:*

*Attesting Officer*

BRUCE LEHMAN

*Commissioner of Patents and Trademarks*